US008425080B2

(12) United States Patent
Konaka

(10) Patent No.: US 8,425,080 B2
(45) Date of Patent: Apr. 23, 2013

(54) LED LAMP

(75) Inventor: Daijiro Konaka, Yokohama (JP)

(73) Assignee: Osram Gesellschaft mit beschrankter Haftung, Munich (DE)

( * ) Notice: Subject to any disclaimer, the term of this patent is extended or adjusted under 35 U.S.C. 154(b) by 639 days.

(21) Appl. No.: 12/310,939

(22) PCT Filed: Sep. 19, 2007

(86) PCT No.: PCT/JP2007/068130
§ 371 (c)(1),
(2), (4) Date: Mar. 12, 2009

(87) PCT Pub. No.: WO2008/035693
PCT Pub. Date: Mar. 27, 2008

(65) Prior Publication Data

US 2009/0201679 A1 Aug. 13, 2009

(30) Foreign Application Priority Data

Sep. 20, 2006 (JP) ..... 2006-253791

(51) Int. Cl.
*F21S 4/00* (2006.01)

(52) U.S. Cl.
USPC ..... 362/249.02; 362/219

(58) Field of Classification Search ..... 362/234, 362/249.01, 249.02, 308–310, 311.02, 404, 362/408, 102, 217.01, 217.02, 217.05, 217.06, 362/217.07, 217.1, 217.11–217.17, 219–225, 362/235–238, 240–248, 249.06, 249.11, 362/249.14, 260, 326–329, 800
See application file for complete search history.

(56) References Cited

U.S. PATENT DOCUMENTS

| | | | | |
|---|---|---|---|---|
| 5,598,280 | A * | 1/1997 | Nishio et al. | 349/57 |
| 5,757,111 | A * | 5/1998 | Sato | 313/111 |
| 6,079,844 | A * | 6/2000 | Whitehead et al. | 362/97.4 |
| 6,109,771 | A * | 8/2000 | Konagaya | 362/497 |
| 6,497,946 | B1 * | 12/2002 | Kretman et al. | 428/317.9 |
| 6,641,284 | B2 * | 11/2003 | Stopa et al. | 362/240 |
| 6,764,196 | B2 * | 7/2004 | Bailey | 362/147 |
| 7,125,141 | B2 * | 10/2006 | Pao et al. | 362/225 |
| 7,187,010 | B2 * | 3/2007 | Tsukagoshi | 257/99 |

(Continued)

FOREIGN PATENT DOCUMENTS

| | | | |
|---|---|---|---|
| JP | 63-33878 | A | 2/1988 |
| JP | 2000-216437 | A | 8/2000 |

(Continued)

*Primary Examiner* — Hargobind S Sawhney
(74) *Attorney, Agent, or Firm* — Holtz, Holtz, Goodman & Chick, P.C.

(57) ABSTRACT

An object is to provide an LED lamp in which the number of LEDs is reduced by using high-intensity LEDs, and point light sources are converted into a linear light source or the like by a light diffusion sheet.
The LED lamp includes an outer shell case 2 with a U shape in section opening on one face, a reflecting plate 3 with a trapezoidal shape in section provided on the side of an opening portion in the outer shell case 2 and opening in the same direction as the outer shell case 2, a plurality of LED modules 5 using high-intensity LEDs 5*a* and mounted on a bottom portion which is a short side of the reflecting plate 3, a diffusion sheet 4 for diffusing light provided near the opening portion of the outer shell case 2, and a lighting circuit 6 for lighting the LEDs 5*a* provided on a bottom portion in the outer shell case 2.

5 Claims, 6 Drawing Sheets

U.S. PATENT DOCUMENTS

| | | | | |
|---|---|---|---|---|
| 7,255,462 | B2 * | 8/2007 | Tseng | 362/330 |
| 7,320,531 | B2 * | 1/2008 | West et al. | 362/231 |
| 7,370,993 | B2 * | 5/2008 | Beeson et al. | 362/327 |
| 7,648,257 | B2 * | 1/2010 | Villard | 362/294 |
| 7,883,232 | B2 * | 2/2011 | Bang | 362/97.3 |
| 2004/0107615 | A1 * | 6/2004 | Pare | 40/544 |
| 2004/0114355 | A1 * | 6/2004 | Rizkin et al. | 362/153 |
| 2005/0243576 | A1 * | 11/2005 | Park et al. | 362/612 |
| 2006/0146531 | A1 * | 7/2006 | Reo et al. | 362/244 |
| 2006/0176562 | A1 * | 8/2006 | Goto | 359/599 |
| 2006/0198128 | A1 * | 9/2006 | Piepgras et al. | 362/147 |
| 2006/0209567 | A1 * | 9/2006 | Sakurai et al. | 362/626 |
| 2007/0047226 | A1 * | 3/2007 | Yu | 362/231 |
| 2007/0070618 | A1 * | 3/2007 | Talamo et al. | 362/153.1 |
| 2007/0183156 | A1 * | 8/2007 | Shan | 362/277 |
| 2008/0043466 | A1 * | 2/2008 | Chakmakjian et al. | 362/237 |
| 2008/0192174 | A1 * | 8/2008 | Odake et al. | 349/62 |
| 2009/0135581 | A1 * | 5/2009 | Yano et al. | 362/84 |

FOREIGN PATENT DOCUMENTS

| | | | |
|---|---|---|---|
| JP | 2001-351402 | A | 12/2001 |
| JP | 2002-367406 | A | 12/2002 |
| JP | 3097580 | U | 4/2003 |
| JP | 2004-20379 | A | 1/2004 |
| JP | 2004-303614 | A | 10/2004 |
| JP | 2005-19260 | A | 1/2005 |

* cited by examiner

LED LAMP

This application is a U.S. National Phase Application under 35 USC 371 of International Application PCT/JP2007/068130, filed Sep. 19, 2007, which is incorporated herein in its entirety by this reference.

TECHNICAL FIELD

The present invention relates to an LED lamp using a light-emitting diode (LED) as a light source.

BACKGROUND ART

As a fluorescent-type LED lamp used by being mounted on a ready-made fluorescent lighting equipment in place of its fluorescent lamp, in order to provide an LED lamp capable of holding mounting postures of plural LEDs easily and accurately, realizing taking-in of power for lighting the respective LEDs, conversion and adjustment of the power with easier configuration, and the like, there has been proposed an LED lamp provided with a plurality of LEDs having legs, a base plate on which the respective LEDs are mounted in a standing manner by their legs, an armoring member on which a plurality of through-holes to be inserted with the respective LEDs mounted on the base plate, for holding their respective postures, are formed according to their respective mounting angles, a protrusion for attachment for being fitted into an insertion hole of a socket of the fluorescent lighting equipment, and a lighting circuit for adjusting power taken in from an external power source by using a power cord to voltage/current for lighting the respective LEDs and supplying the voltage/current to the respective LEDs (for example, see Patent Reference 1).

Patent Reference 1: JP-A-2004-303614

DISCLOSURE OF THE INVENTION

Problem to be Solved by the Invention

However, the above fluorescent-type LED lamp which has been proposed has the following problems.

Since the plurality of LEDs are disposed at intervals, shadows generated when lights hit on an object are not superimposed, which results in generation of a plurality of shadows.

Since high-intensity LEDs have not been used, it is necessary to use many LEDs. Therefore, the shape of the LED lamp is enlarged, and its weight is also increased.

The present invention has been made for solving such problems as described above, and an object thereof is to provide an LED lamp in which the number of LEDs to be used is reduced by using high-intensity LEDs, and point light sources can be converted into a linear light source or the like by a light diffusion sheet.

Means for Solving the Problem

An LED lamp according to the present invention comprises an outer shell case with a U shape in section opening on one face, a reflecting plate with a trapezoidal shape in section provided on the side of an opening portion in the outer shell case and opening in the same direction as the outer shell case and, a plurality of LED modules using high-intensity LEDs and mounted on a bottom portion which is a short side of the reflecting plate, a diffusion sheet for diffusing light provided near the opening portion of the outer shell case, and a lighting circuit for lighting the LEDs provided on a bottom portion in the outer shell case.

Further, the LED lamp according to the present invention has a configuration that a diffusion prism is provided on the diffusion sheet.

Further, the LED lamp according to the present invention has a configuration that the shape of the diffusion sheet is wagon-head.

Further, the LED lamp according to the present invention is a linear LED lamp in which the outer shell case is linear, and a diffusion sheet in which a diffusion angle in one direction is larger than diffusion angles in the other directions is used for as diffusion sheet.

Further, the LED lamp according to the present invention is a circular LED lamp in which the outer shell case is circular, and a diffusion sheet in which diffusion angles are large omnidirectionally is used as the diffusion sheet.

Effect of the Invention

Since the LED lamp according to the present invention uses the high-intensity LED modules, the number of LEDs can be reduced, so that reduction in size and weight becomes possible.

Further, since the diffusion sheet is provided on the opening portion of the outer shell case, point light sources of the LEDs are converted into a linear light source, so that shadows generated when lights hit on an object are superimposed, which results in a light source approximately equivalent to a fluorescent lamp.

Further, since the diffusion prism is added onto the diffusion sheet, light can be extended along the diffusion prism.

Further, the diffusion sheet is made into a shape of wagon-head, thereby a distance between the diffusion sheet and the LEDs becomes large, therefore the point light sources of the LEDs are converted into a more linear light source, so that shadows generated when lights hit on an object are superimposed, which results in a light source approximately equivalent to a fluorescent.

BRIEF DESCRIPTION OF THE DRAWINGS

FIG. 1(*a*) shows a plan view of a linear LED lamp 1 and FIG. 1(*b*) shows a side view thereof.

FIG. 5(*a*) shows a plan view of a circular LED lamp 20 and FIG. 5(*b*) shows a side view thereof.

EXPLANATION OF REFERENCE NUMERALS

1: linear LED lamp, 2: outer shell case, 3: reflecting plate, 4: diffusion sheet, 5: LED module, 5*a*: LED, 5*b*: base plate, 5*c*: reflector, 6: lighting circuit, 7: diffusion prism, 10: base, 10*a*: base pin, 11: wagon-head diffusion sheet, 20: circular LED lamp, 21: omnidirectional diffusion sheet.

Best Mode for Carrying out the Invention

First Embodiment

Figure 1:
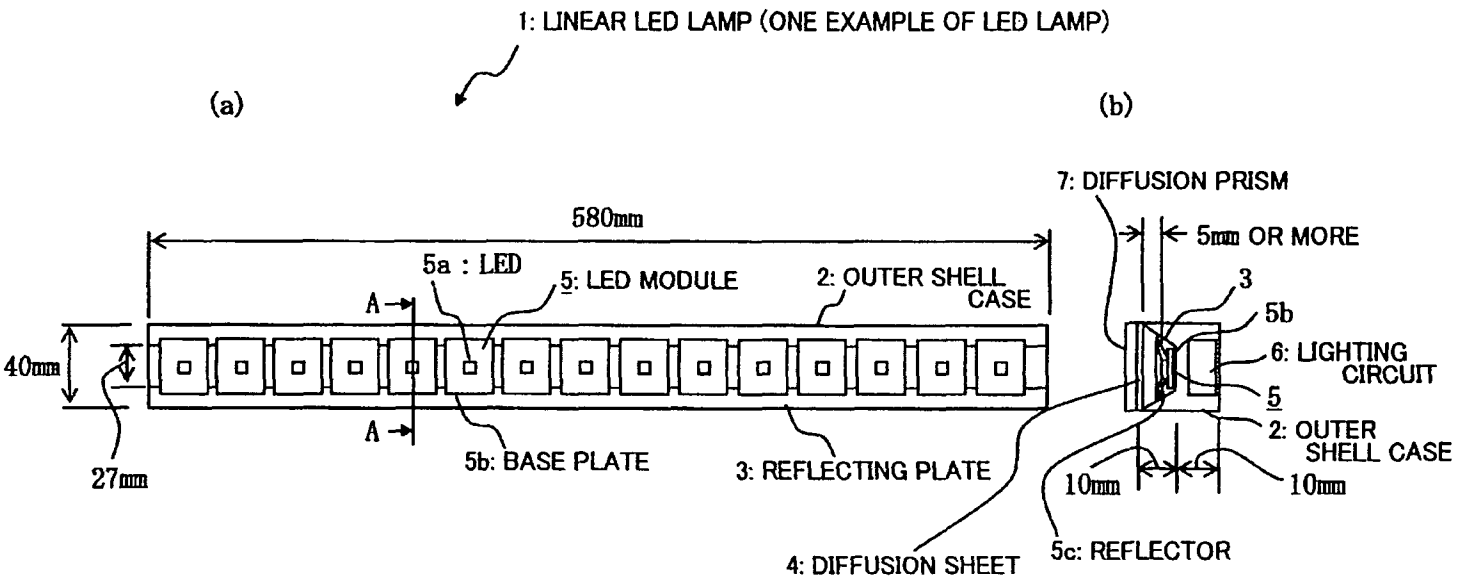
FIG. 1 shows a first embodiment.
Figure 2:
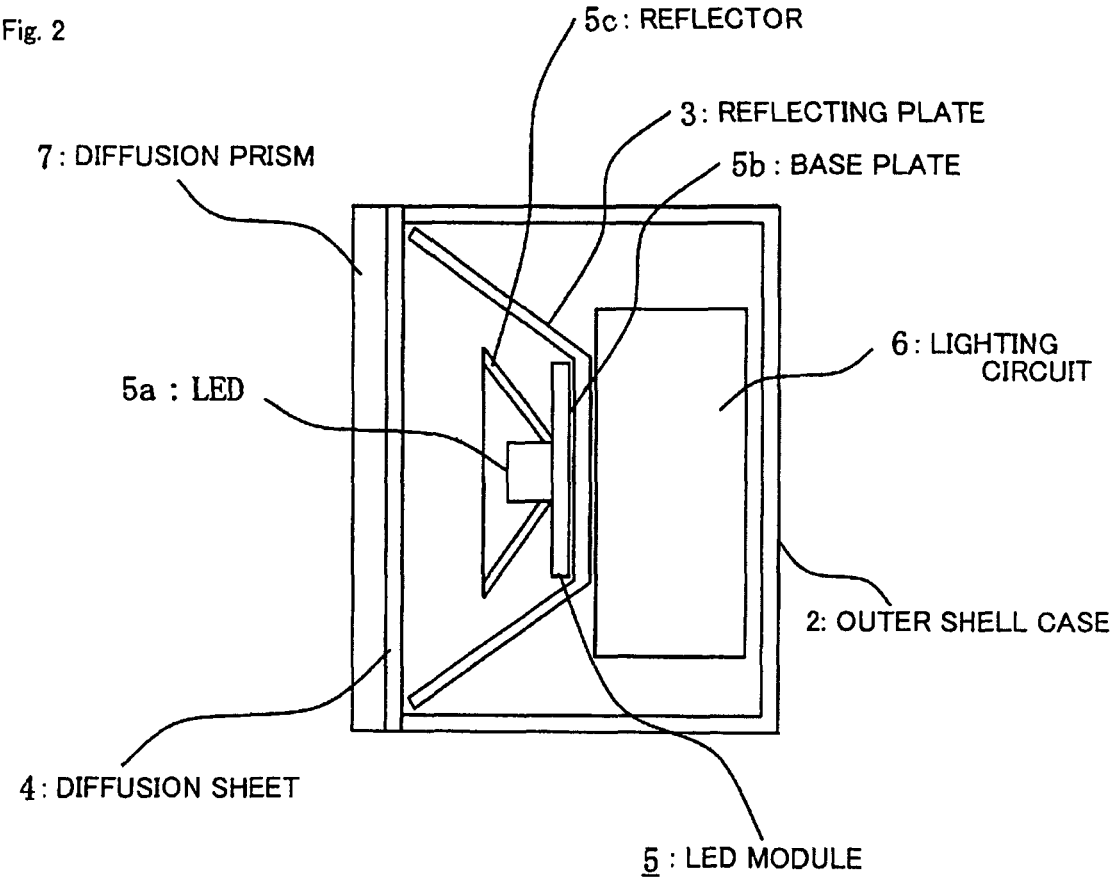
FIG. 2 shows the first embodiment and a sectional view taken along line A-A in FIG. 1.
Figure 3:
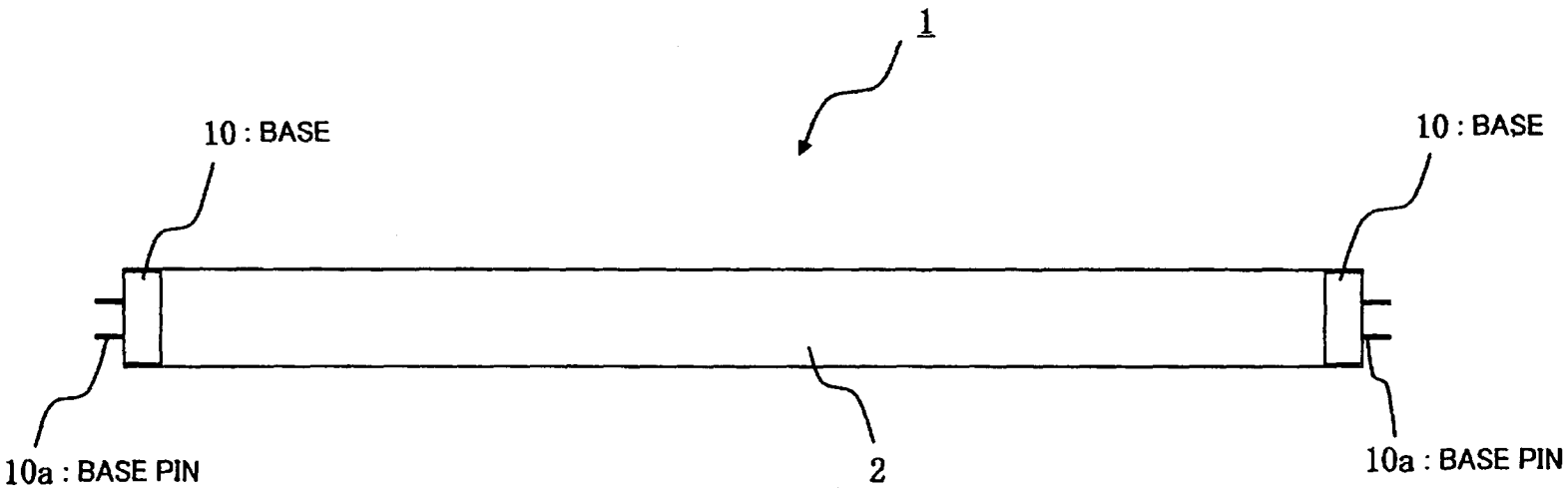
FIG. 3 shows the first embodiment and an appearance view of the linear LED lamp 1.

FIGS. 1 to 3 show a first embodiment. FIG. 1(*a*) shows a plan view, FIG. 1(*b*) shows a side view of a linear LED lamp 1, FIG. 2 shows a sectional view taken along line A-A in FIG. 1, and FIG. 3 shows an appearance view of the linear LED lamp 1.

As shown in FIG. 1, the linear LED lamp 1 (one example of an LED lamp) houses LED modules 5, a lighting circuit 6, and the like in a slender outer shell case 2 with a U shape in section. The linear LED lamp 1 in FIG. 1 aims to obtain brightness corresponding to a straight-tube-type fluorescent lamp of 20 watts, and uses fifteen high-intensity LED modules 5. The size of the outer shell case 2 is 580 mm in length, 40 mm in width, and 20 mm in height, for one example. The material of the outer shell case 2 is aluminum, and the thickness thereof is 1 mm or more.

The lighting circuit 6 for lighting the LED modules 5 is provided near a bottom portion of the outer shell case 2. The lighting circuit 6 is a known one for adjusting power taken in from a commercial power source to voltage/current for lighting the respective LED modules 5 and supplying the voltage/current to the respective LED modules 5.

Fifteen high-intensity LED modules 5 are disposed linearly side by side on a bottom portion which is a short side of a reflecting plate 3 with a trapezoidal shape in section. The LED modules 5 include a base plate 5*b*, respectively, and an LED 5*a* is attached on the base plate 5*b*. The base plate 5*b* of the LED module 5 is fixed on the bottom portion of the reflecting plate 3 by using a double-faced tape. The LED module 5 includes, around the LED 5*a*, a reflector 5*c* made from resin or metal optimally designed to reflect light efficiently in an anterior direction (see FIG. 2).

The reflecting plate 3 is disposed on the side of the opening portion of the outer shell case 2 so that light is emitted toward the opening portion. The brightness of the high-intensity LED module 5 is about 20 lm (lumen) at present, and the brightness thereof reaches about 300 lm even at a time of using fifteen high-intensity LED modules 5, but by performing optimized design using a diffusion sheet 4 described later or the like, surface illuminance at one position from a light source is secured.

The unidirectional diffusion sheet 4 in which a diffusion angle in one direction is larger than a diffusion angle in a direction orthogonal thereto is attached to the opening portion of the outer shell case 2. The direction larger in diffusion angle of the diffusion sheet 4 is caused to correspond to a longitudinal direction of the outer shell case 2. The diffusion angle of the unidirectional diffusion sheet 4 is 35 degrees or more in a direction larger in diffusion angle and 20 degrees or less in a direction orthogonal thereto.

Incidentally, a distance between the diffusion sheet 4 and the LEDs 5*a* is set to 5 mm or more. It is preferable to separate the diffusion sheet 4 from the LEDs 5*a* as much as possible in order to diffuse light from the LEDs 5*a*. With such a configuration, point light sources of the fifteen LEDs 5*a* are converted into a linear light source. Shadows generated when the lights hit on an object are superimposed, and a light source approximately equivalent to a fluorescent lamp is obtained.

As shown in FIG. 1, a diffusion prism 7 may be added onto the diffusion sheet 4. By adding the diffusion prism 7, light can be extended in the longitudinal direction.

In order to allow the linear LED lamp 1 to be used by being mounted on a ready-made fluorescent lighting equipment in place of its fluorescent lamp, bases 10 of a straight-tube-type fluorescent lamp are mounted on both end portions of the outer shell case 2 in a longitudinal direction thereof, as shown in FIG. 3. Since a base of a fluorescent lamp generally includes two base pins for heating a filament, one base pin 10*a* is sufficient for the linear LED lamp 1, but two base pins 10*a* are provided according to the base of the fluorescent lamp.

As described above, since the linear LED lamp 1 according to the first embodiment uses high-intensity LED modules 5, the number of LEDs can be reduced, so that reduction in size and weight becomes possible.

Further, since the diffusion sheet 4 in which a diffusion angle in one direction is larger than diffusion angles in the other directions is used on the opening portion of the outer shell case 2, the point light sources of the LEDs 5*a* are converted into a linear light source. Shadows generated when the lights hit on an object are superimposed, and a light source approximately equivalent to a fluorescent lamp is obtained.

Further, the diffusion prism 7 is added onto the diffusion sheet 4, thereby light can be extended in the longitudinal direction.

Second Embodiment

Figure 4:
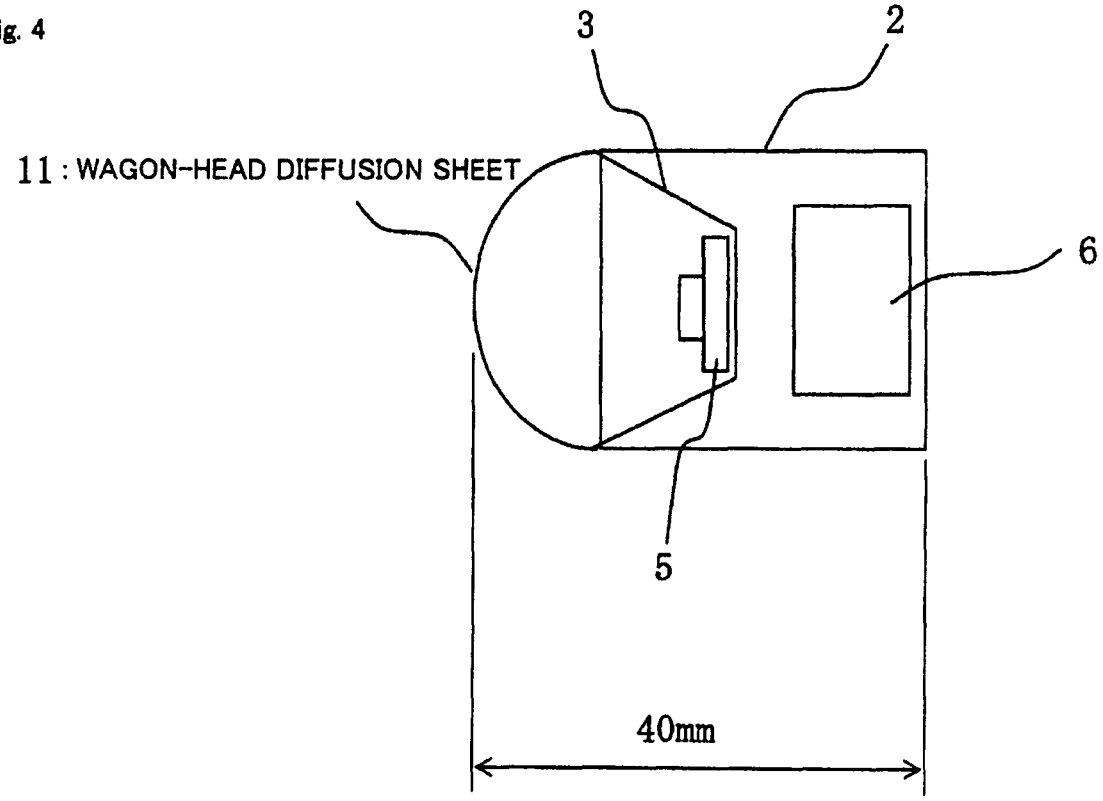
FIG. 4 shows a second embodiment and a sectional view of the linear LED lamp 1.

FIG. 4 shows a second embodiment and a sectional view of a linear LED lamp 1.

Though a flat-plate-like diffusion sheet 4 is used in the first embodiment, a wagon-head diffusion sheet 11 is used here as shown in FIG. 4. The other is the same as the first embodiment. In this case, the height of the linear LED lamp 1 is about 40 mm.

As described above, separating a diffusion sheet from the LEDs 5*a* as much as possible is more effective in light diffusion. Since a distance from the LEDs 5*a* becomes larger as compared to the flat-plate-like diffusion sheet 4 owing to the wagon-head diffusion sheet 11, the point light sources of the LEDs 5*a* are converted into an improved linear light source, so that shadows generated when lights hit on an object are superimposed, and a light source approximately equivalent to a fluorescent lamp is obtained.

Third Embodiment

Figure 5:
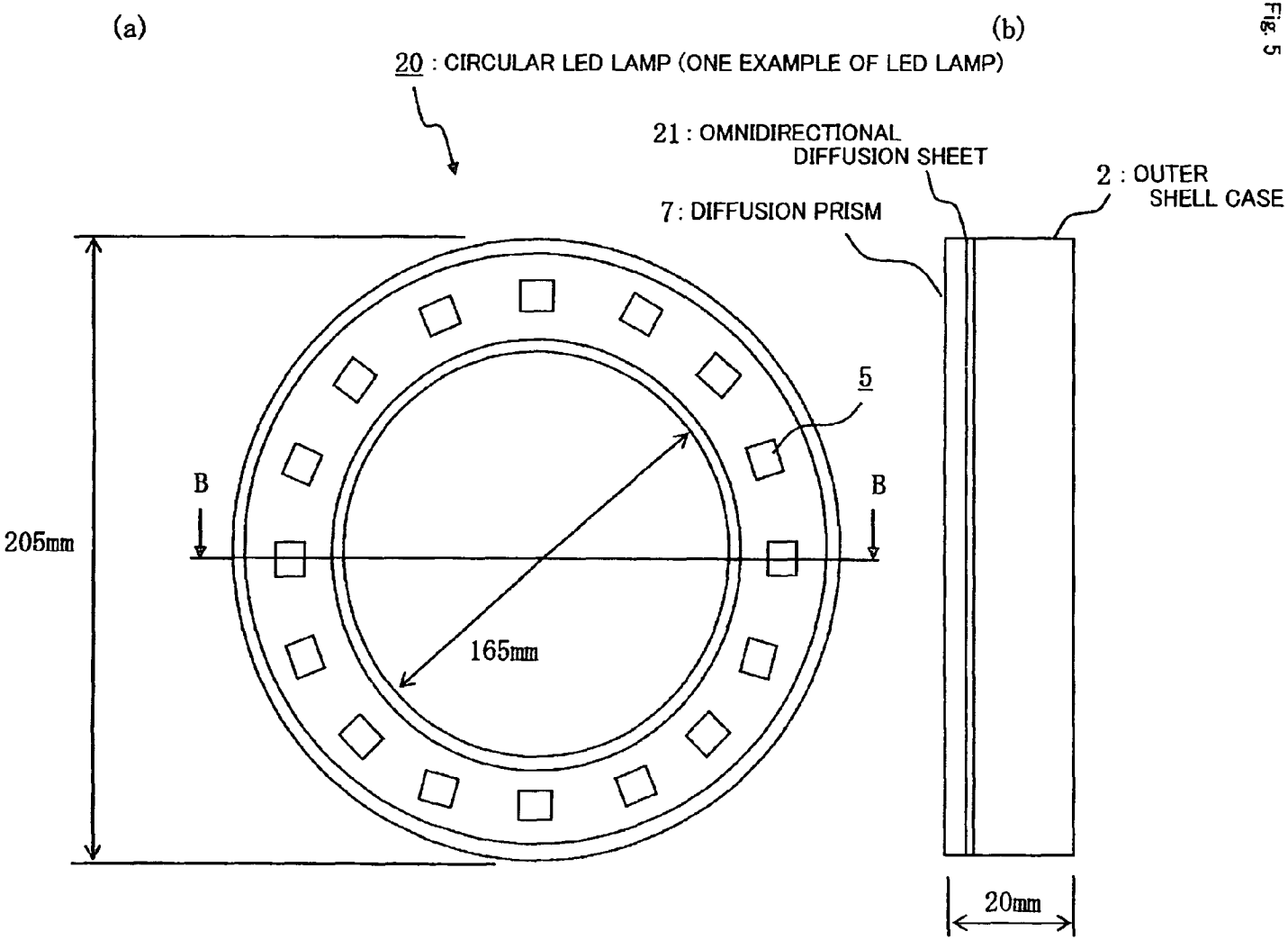
FIG. 5 shows a third embodiment.

FIG. 5 shows a third embodiment. FIG. 5(*a*) shows a plan view of a circular LED lamp 20 and FIG. 5(*b*) shows a side view thereof; and FIG. 6 shows a sectional view taken along line B-B.

A circular LED lamp 20 (one example of an LED lamp) shown in FIG. 5 is the same in basic structure as the linear LED lamp 1 of the first embodiment. The circular LED lamp 20 in FIG. 5 aims to obtain brightness corresponding to a circular fluorescent lamp of 20 watts, and uses sixteen high-intensity LED modules 5. The size of an annular (circular) outer shell case 2 is 205 mm in outer diameter, 165 mm in inner diameter, and 20 mm in height, for one example. The material of the outer shell case 2 is aluminum, and the thickness thereof is 1 mm or more.

In the circular LED lamp 20, a diffusion sheet provided on the opening portion of the outer shell case 2 is an omnidirectional diffusion sheet 21 in which light is diffused omnidirectionally. In the omnidirectional diffusion sheet 21, a light diffusion angle is 20 degrees or more omnidirectionally.

Figure 6:
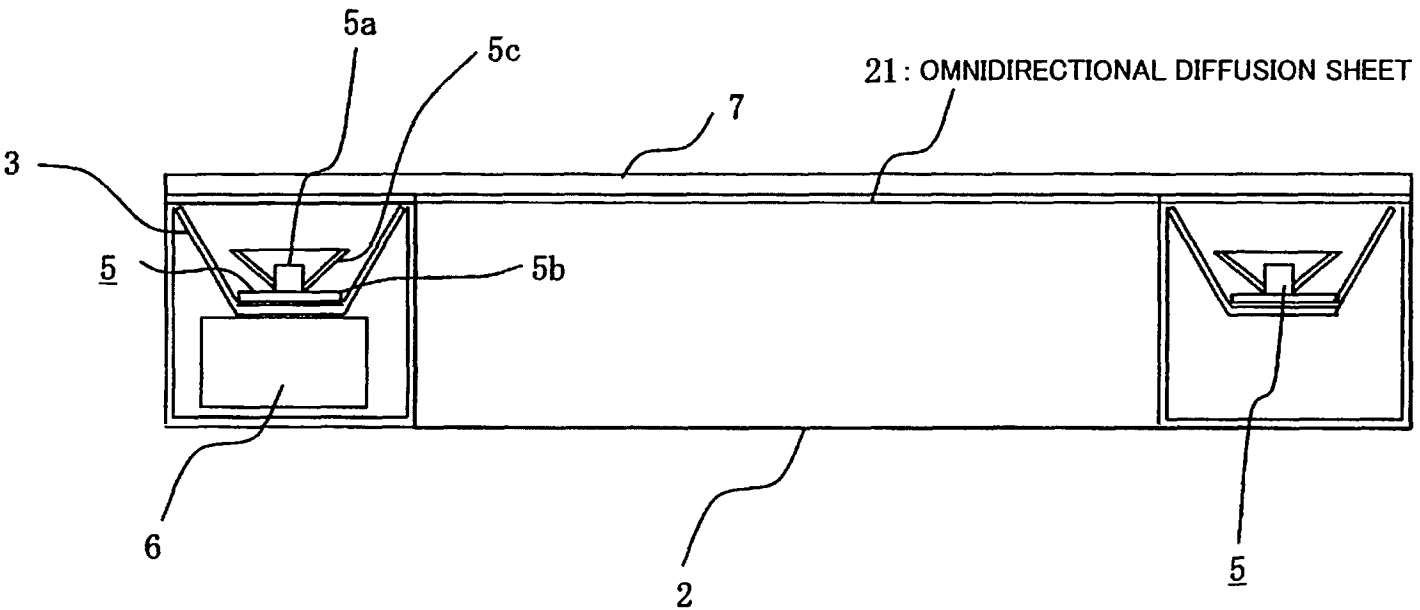
FIG. 6 shows the third embodiment and a sectional view taken along line B-B.

As shown in the sectional view of FIG. 6, the configuration of the circular LED lamp 20 is the same as the linear LED lamp 1, except for the omnidirectional diffusion sheet 21.

In the circular LED lamp 20, by using the omnidirectional diffusion sheet 21, light of the LEDs 5*a* is diffused circumferentially, so that point light sources are converted into an annular light source (circular light source) in which the point light sources looks like connecting to each other annularly (circularly).

Similarly to the first embodiment, the diffusion prism 7 may be added onto the omnidirectional diffusion sheet 21. Owing to optimization of the diffusion prism 7, light can be efficiently diffused circumferentially.

As described above, since the circular LED lamp 20 according to the third embodiment uses the high-intensity LED modules 5, the number of LEDs can be reduced, so that reduction in size and weight becomes possible.

Further, the omnidirectional diffusion sheet 21 is used on the opening portion of the outer shell case 2, thereby light of the LEDs 5*a* is diffused circumferentially, so that point light sources are converted into an annular light source (circular light source) in which the point light sources looks like connecting to each other annularly (circularly).

Further, the diffusion prism 7 is added onto the omnidirectional diffusion sheet 21, thereby light can be efficiently diffused circumferentially because of optimization of the diffusion prism 7.

Incidentally, in the present embodiment, the shape of the omnidirectional diffusion sheet 21 may be wagon-head. Thereby, the light diffusion effect is enhanced.

The invention claimed is:

1. An LED lamp comprising:

an outer shell case having a substantially U shape in section, wherein the outer shell case includes an opening portion at a top portion thereof, and wherein the opening portion is open towards a first direction;

a reflecting plate having a trapezoidal shape in section, wherein the reflecting plate is provided in the outer shell case and on a side of the opening portion of the outer shell case, and wherein the reflecting plate is open towards the first direction;

a plurality of LED modules using high-intensity LEDs mounted on a bottom portion of the reflecting plate, wherein the bottom portion is a short side of the reflecting plate;

a diffusion sheet for diffusing light, wherein the diffusion sheet is provided near the opening portion of the outer shell case; and a lighting circuit for lighting the LEDs, wherein the lighting circuit is provided in the outer shell case and on a bottom portion of the outer shell case.

2. The LED lamp according to claim 1, wherein a diffusion prism is provided on the diffusion sheet.

3. The LED lamp according to claim 1, wherein a shape of the diffusion sheet is a wagon-head in section.

4. The LED lamp according to any one of claims 1 to 3, wherein the LED lamp is a linear LED lamp in which the outer shell case is linear, and the diffusion sheet has a diffusion angle in one direction larger than diffusion angles in other directions.

5. The LED lamp according to any one of claims 1 to 3, wherein the LED lamp is a circular LED lamp in which the outer shell case is circular, and the diffusion sheet has large omnidirectional diffusion angles.

* * * * *